US009056477B2

(12) United States Patent
Miyajima

(10) Patent No.: US 9,056,477 B2
(45) Date of Patent: Jun. 16, 2015

(54) BACKPRESSURE CONTROL UNIT, LIQUID EJECTING HEAD, AND LIQUID EJECTING APPARATUS

(71) Applicant: Seiko Epson Corporation, Tokyo (JP)

(72) Inventor: Hiroki Miyajima, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/133,827

(22) Filed: Dec. 19, 2013

(65) Prior Publication Data

US 2014/0198144 A1 Jul. 17, 2014

(30) Foreign Application Priority Data

Jan. 16, 2013 (JP) ..... 2013-005801

(51) Int. Cl.
*B41J 2/175* (2006.01)

(52) U.S. Cl.
CPC ..... *B41J 2/175* (2013.01); *B41J 2/17556* (2013.01)

(58) Field of Classification Search
CPC ..... B41J 2/17596
See application file for complete search history.

(56) References Cited

U.S. PATENT DOCUMENTS

| | | | | |
|---|---|---|---|---|
| 6,984,030 | B2 * | 1/2006 | Shinada et al. | 347/86 |
| 2002/0071011 | A1 * | 6/2002 | Hayashi et al. | 347/86 |
| 2003/0146958 | A1 | 8/2003 | Aruga et al. | |
| 2005/0231563 | A1 | 10/2005 | Fujishiro et al. | |
| 2007/0182792 | A1 * | 8/2007 | Akahane | 347/86 |
| 2007/0222834 | A1 * | 9/2007 | Seshimo et al. | 347/85 |
| 2009/0002469 | A1 * | 1/2009 | Imai et al. | 347/93 |
| 2009/0153630 | A1 * | 6/2009 | Ito et al. | 347/85 |
| 2012/0050422 | A1 * | 3/2012 | Kondo | 347/85 |
| 2012/0127242 | A1 * | 5/2012 | Koike et al. | 347/85 |

FOREIGN PATENT DOCUMENTS

| | | | |
|---|---|---|---|
| JP | 2005-186344 | A | 7/2005 |
| JP | 2008-230196 | A | 10/2008 |
| WO | WO-03041964 | A1 | 5/2003 |
| WO | WO 2012075792 | A1 * | 6/2012 |

* cited by examiner

*Primary Examiner* — Shelby Fidler
(74) *Attorney, Agent, or Firm* — Harness, Dickey & Pierce, P.L.C.

(57) ABSTRACT

A backpressure control unit that introduces a liquid from an external liquid holding unit and supplies the liquid to a main head unit for ejecting the liquid via a nozzle opening includes a flow channel member having an introduction channel, a valve member, and a supply channel, and a cover that that combines a base portion and a cover portion and houses the flow channel member therewithin. This provides a backpressure control unit that improves yields by absorbing discrepancies in properties of backpressure control valves to the greatest extent possible while at the same time making it possible to change designs in a flexible manner.

6 Claims, 5 Drawing Sheets

BACKPRESSURE CONTROL UNIT, LIQUID EJECTING HEAD, AND LIQUID EJECTING APPARATUS

BACKGROUND

1. Technical Field

The present invention relates to backpressure control units for supplying a liquid to a main head unit of a liquid ejecting head that ejects the liquid from nozzle openings, and furthermore relates to liquid ejecting heads and liquid ejecting apparatuses that include such backpressure control units; the invention is particularly useful when applied in a backpressure control unit having a flow channel member.

2. Related Art

An ink jet recording head, which is an example of a liquid ejecting head, prints onto a medium such as paper by instigating pressure changes in pressure generation chambers that communicate with nozzle openings and ejecting ink droplets from the nozzle openings onto the medium. Providing a flow channel member, for supplying ink to a main head unit having the nozzle openings, in a valve unit (a backpressure control unit) has been proposed as an example of this type of ink jet recording head (see JP-A-2005-186344, for example).

In the flow channel member of the backpressure control unit according to JP-A-2005-186344, a plurality of backpressure control valves (for example, seven) having springs that adjust the pressure in individual flow channels are provided, and the entire unit is integrated as a single entity by being covered by a cover, formed of a resin, having positive water vapor barrier properties.

As described above, with the flow channel member according to JP-A-2005-186344, a plurality of rows are integrated and housed within the cover, and thus there is a problem, particularly when multiple colors of ink are used, where there are discrepancies among the properties of the backpressure control valves in each valve unit caused by warping and the like in the overall apparatus, including the cover. Furthermore, in the case where the number of rows is to be changed in order to increase the number of colors or the like, it is necessary to redo the overall design and change the process for manufacturing the unit as well. In other words, the flow channel member lacks generic applicability.

It should be noted that these problems are not limited to ink jet recording heads, and are also present in other liquid ejecting heads that eject liquids aside from ink.

SUMMARY

It is an advantage of some aspects of the invention to provide a backpressure control unit, a liquid ejecting head, and a liquid ejecting apparatus that improve yields by absorbing discrepancies in properties of backpressure control valves to the greatest extent possible while at the same time making it possible to change designs in a flexible manner.

A first aspect of the invention for solving the aforementioned problems is described hereinafter.

A backpressure control unit that introduces a liquid from an external liquid holding unit and supplies the liquid to a main head unit for ejecting the liquid via a nozzle opening includes: a flow channel member including an introduction channel that introduces the liquid from the liquid holding unit, a valve member that configures a backpressure control valve, and a supply channel that supplies the liquid that has exited the valve member to the main head unit; and a cover including a base portion that holds the flow channel member on one side of the flow channel member, a cover portion that covers the flow channel member on the other side of the flow channel member and houses the flow channel member in a space configured between the base portion and the cover portion, and a supply port that conducts the liquid to the main head unit downstream from the supply channel. Here, the flow channel member is divided into a plurality of blocks.

According to this aspect, the flow channel member having the backpressure control valve is divided into a plurality of blocks and disposed in the base portion; it is thus possible to suppress to the greatest extent possible discrepancies in the properties of the backpressure control valves throughout the entire flow channel member caused by warping in the backpressure control unit that is configured integrally with the flow channel member and the cover, caused by properties of the backpressure control valves themselves, and so on.

Furthermore, design changes can be made to the backpressure control unit in a flexible manner simply by changing the combinations of a number of the flow channel members resulting from the division.

Here, it is desirable for each block of the respective flow channel members to be formed so as to be attachable to and removable from the base portion. According to this embodiment, by changing the combinations of the flow channel member in various ways, discrepancies in the properties of the backpressure control valve can be adjusted with ease, and furthermore, the number of flow channel members that are combined can be increased and decreased with a higher degree of flexibility. In addition, it is desirable for the respective flow channel members and the base portion to be connected by applying pressure in a direction that intersects with the surfaces of connection between the flow channel members and the base portion. This is because it is possible to ensure a favorable sealed state at a linking portion between the connection portions of the flow channel member and the base portion. Specifically, the configuration may be such that, for example, pin members disposed in the base portion are inserted into sealing members configured of a ring-shaped elastic members disposed toward the flow channel members.

A liquid ejecting head according to another aspect of the invention includes any of the aforementioned backpressure control units.

According to this aspect, the backpressure can be appropriately adjusted, and thus favorable ejecting properties can be obtained.

Furthermore, another aspect of the invention is a liquid ejecting apparatus including the liquid ejecting head according to the aforementioned aspect.

According to this aspect, high quality printed materials and the like can be obtained with ease.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on embodiments.

First Embodiment

Figure 1:
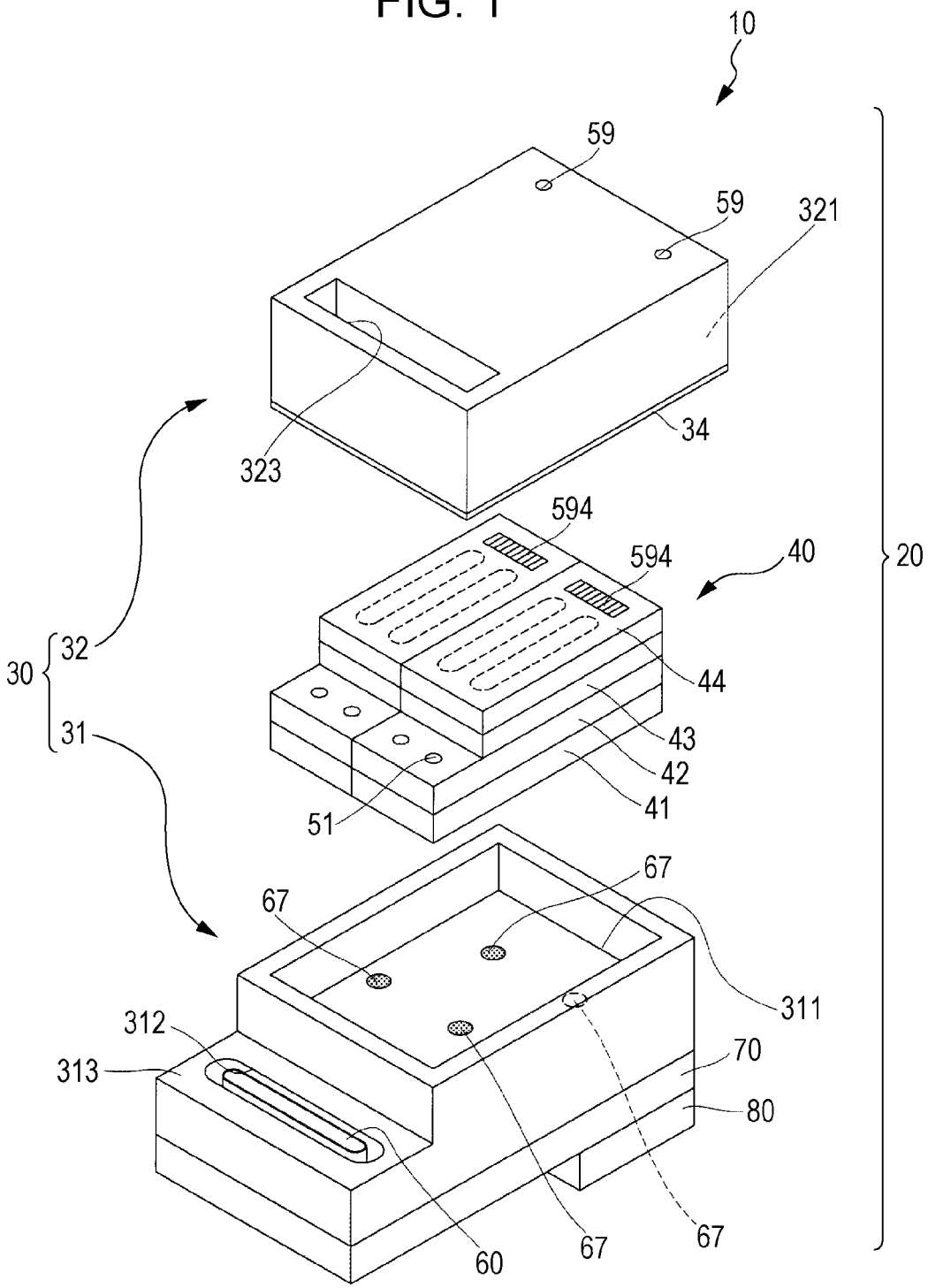
FIG. 1 is an exploded perspective view of a recording head according to a first embodiment of the invention.
Figure 2:
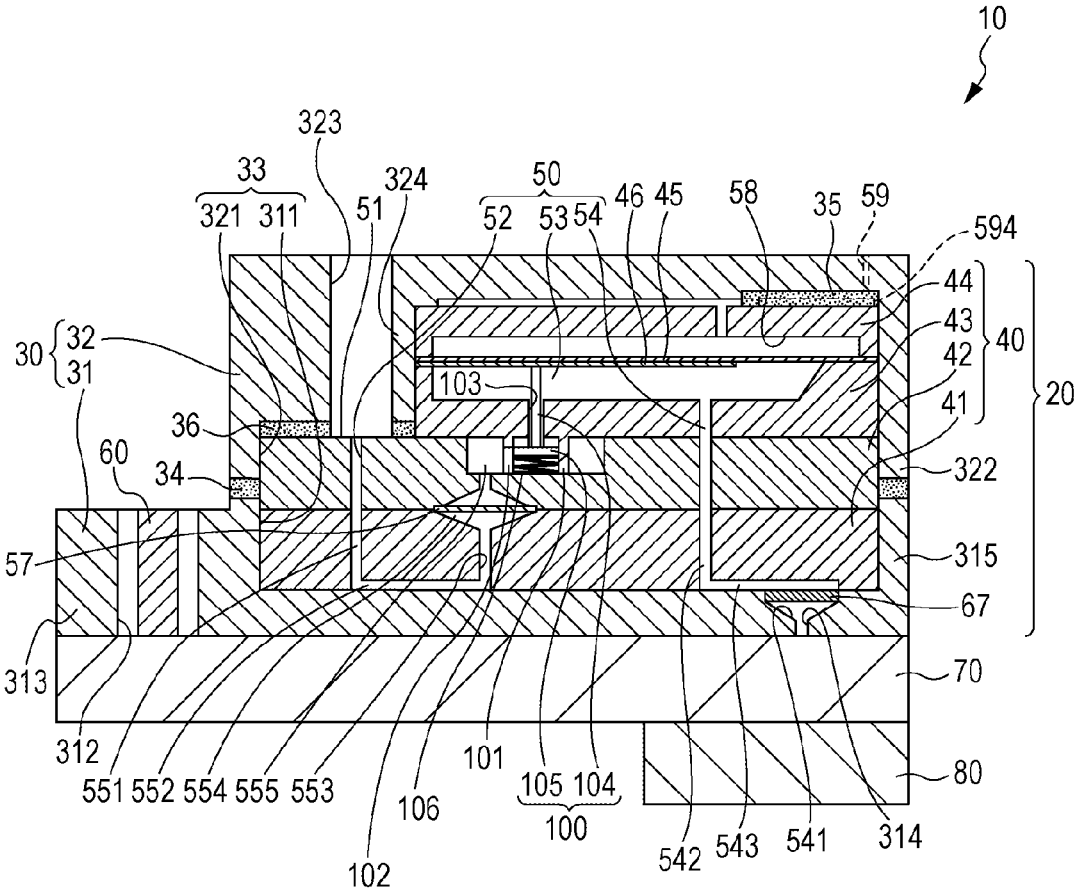
FIG. 2 is a cross-sectional view of the content shown in FIG. 1.

FIG. 1 is an exploded perspective view of an ink jet recording head serving as an example of a liquid ejecting head according to a first embodiment of the invention, whereas FIG. 2 is a cross-sectional view illustrating the same.

As illustrated in FIGS. 1 and 2, an ink jet recording head (also called simply a "recording head") 10 serving as an example of the liquid ejecting head according to the first embodiment of the invention includes a backpressure control unit 20, a circuit board 60 provided in a base area of the backpressure control unit 20, a head case 70 provided below the backpressure control unit 20, and a plurality of main head units 80 anchored to the head case 70.

The backpressure control unit 20 supplies ink from a liquid holding unit (not shown) such as an external ink tank that holds ink, to the main head units 80.

Here, the backpressure control unit 20 will be described in detail. The backpressure control unit 20 includes a cover 30 configured of a hollow box-shaped member, and a flow channel member 40 serving as a valve unit provided within the cover 30.

The cover 30 is divided vertically into a base portion 31 and a cover portion 32. In other words, the cover 30 includes the base portion 31 disposed on one side (a lower side) of the flow channel member and the cover portion 32 disposed on the other side (an upper side) of the flow channel member. The base portion 31 includes a first holding portion 311 having a concave shape that opens toward the cover portion 32, and a support portion 313 provided on one end of the first holding portion 311 and including a wiring insertion hole 312 that passes through the support portion 313 in the thickness direction thereof.

Filters 67 that connect to a plurality of supply ports 314 that pass through in the thickness direction and supply ink to the main head units 80 are provided in a base surface of the first holding portion 311 of the base portion 31.

The cover portion 32 is sized to cover the first holding portion 311 of the base portion 31, and includes a second holding portion 321 (inner surface) that faces the first holding portion 311 of the base portion 31 and has a concave shape that opens toward the base portion 31.

As shown in FIG. 2, a holding portion 33, which is an internal space defined by the first holding portion 311 and the second holding portion 321, is formed by anchoring the base portion 31 and the cover portion 32 so that the first holding portion 311 and the second holding portion 321 oppose each other.

A first wall portion 315 that defines a side surface of the first holding portion 311 is provided in the base portion 31. Meanwhile, a second wall portion 322 that defines a side surface of the second holding portion 321 is provided in the cover portion 32. The base portion 31 and the cover portion 32 are connected and anchored to each other by bringing a leading end surface of the first wall portion 315 into contact with a leading end surface of the second wall portion 322 and applying pressure in a direction that intersects with the connection surfaces of the two portions (for example, a direction perpendicular to the connection surface/a vertical direction).

At this time, a first sealing member 34 configured of rubber, an elastomer, or the like is pinched between the first wall portion 315 and the second wall portion 322. Meanwhile, the cover 30 itself, which is configured of the base portion 31 and the cover portion 32, is formed of a resin material having high water vapor barrier properties, and as will be described later, is configured to suppress to the greatest extent possible the evaporation of water content of the ink through a film member 45 and so on of a backpressure control valve portion of the flow channel member 40.

An opening portion 323 that communicates with a base surface of the second holding portion 321 is provided in the cover portion 32, passing therethrough in the thickness direction. The flow channel member 40, which is held by the holding portion 33 configured of the first holding portion 311 and the second holding portion 321, is divided into a plurality (two, in FIG. 1) of blocks having the same configurations, and is arranged in the base portion 31. In this embodiment, each block of the flow channel member 40 is affixed and anchored to the base portion 31 using an adhesive. Disposing the flow channel member 40 in such a divided manner makes it possible to suppress to the greatest extent possible discrepancies in the properties of the overall backpressure control unit 20 caused by warping in the member, the properties of the backpressure control valve itself (described later), and so on.

Accordingly, in this embodiment, each block resulting from dividing the flow channel member 40 into a plurality of blocks includes a first flow channel member 41 provided toward the base portion 31, a second flow channel member 42 provided above the first flow channel member 41, a pressure chamber formation portion 43 provided above the second flow channel member 42, and a protective plate 44 provided above the pressure chamber formation portion 43.

The first flow channel member 41, the second flow channel member 42, the pressure chamber formation portion 43, and the protective plate 44 are each formed as plate-shaped members configured of a resin material, a metal material, or the like. The first flow channel member 41, the second flow channel member 42, the pressure chamber formation portion 43, and the protective plate 44 are held within the holding portion 33 of the cover 30 in a stacked state.

A liquid flow channel 50 that supplies ink from the external liquid holding unit that holds the ink to the main head unit 80 is provided in the first flow channel member 41, the second flow channel member 42, and the pressure chamber formation portion 43 that configure the flow channel member 40.

Specifically, as shown in FIG. 2, the liquid flow channel 50 includes: an introduction channel 52 having a connection port 51 to which one end of a supply pipe (not shown), which is a pipe-shaped member such as a tube, is connected, the other end of the supply pipe being connected to the liquid holding unit; a chamber 53 into which the ink is supplied from the introduction channel 52; and a supply channel 54 that supplies the ink from the chamber 53 to the main head unit 80 via the filter 67 and the head case 70.

Here, the connection port 51 is provided as an opening in a top surface of the second flow channel member 42. A plurality of connection ports 51 are provided so as to correspond to a plurality of inks. In this embodiment, four connection ports 51 are provided in correspondence with each opening portion 323.

The introduction channel 52 having the connection port 51 is configured of a flow channel that passes through the second flow channel member 42 and the first flow channel member 41, a flow channel provided between the second flow channel member 42 and the first flow channel member 41, a flow channel that passes between the first flow channel member 41 and the base portion 31, and so on.

As shown in FIG. 2, the introduction channel 52 includes: a first introduction flow channel 551 that passes through the second flow channel member 42 and the first flow channel member 41 in the thickness direction thereof; a second introduction flow channel 552, formed in a concave shape in a base surface of the first flow channel member 41, that communicates at one end with the first introduction flow channel 551; a third introduction flow channel 553 provided so as to communicate with the other end of the second introduction flow channel 552 and to pass through the first flow channel member 41; a filter chamber 554 that is provided between the first flow channel member 41 and the second flow channel member 42 and that communicates with the third introduction flow channel 553; and a fourth introduction flow channel 555 that communicates with the filter chamber 554 and passes through the second flow channel member 42. In other words, a first introduction channel 55 passes between the first flow channel member 41 and the base portion 31 and reaches the chamber 53.

A filter 57 that removes foreign objects such as debris, bubbles, and the like from the ink is provided in the filter chamber 554 that is in turn provided partway along the introduction channel 52. Here, the third introduction flow channel 553 and the fourth introduction flow channel 555 each communicate with the filter chamber 554 located partway along the introduction channel 52, with the filter 57 of the filter chamber 554 interposed between the stated flow channels. Through this, the ink supplied from the third introduction flow channel 553 passes through the filter 57 and is supplied to the fourth introduction flow channel 555. Accordingly, the introduction channel 52 communicates with each chamber 53 provided in the pressure chamber formation portion 43.

The chamber 53 has a concave shape that opens toward the opposite side as the side on which the second flow channel member 42 of the pressure chamber formation portion 43, which is a plate-shaped member, is provided. The chamber 53 communicates with the introduction channel 52 via its base surface on one end in the lengthwise direction, and communicates with the supply channel 54 via its base surface on the other end in the lengthwise direction.

The chamber 53 is sealed by the film member 45, which is provided over the open surface of the pressure chamber formation portion 43. Here, the film member 45 is a flexible thin membrane-type film, and is anchored to the surface of the pressure chamber formation portion 43 through thermal welding or the like. Vylon®, for example, can be used favorably for the film member 45. A film member requires a certain degree of water vapor barrier properties as well as a predetermined elasticity and strength, all of which are provided by Vylon®, and Vylon® furthermore provides a sufficient elasticity and a sufficient strength with a small surface area, which enables the film member 45 to have a small surface area; this in turn makes it possible to reduce the size of the backpressure control valve, which makes it possible to reduce the size of the backpressure control unit 20 as well.

The film member 45 is formed under pressure so as to bulge in a dome shape within the chamber 53.

Furthermore, an elastic plate 46 is disposed within the chamber 53 of the pressure chamber formation portion 43, toward the side on which the film member 45 is located. The elastic plate 46 is provided so as to protrude into the chamber 53, with one end of the elastic plate 46 being anchored to a surface of the pressure chamber formation portion 43; the leading end of the elastic plate 46 serves as a free end within the chamber 53. In this embodiment, the elastic plate 46 is formed of a common portion on the anchoring end side thereof that is shared among a plurality of elastic plates 46 and an elastic portion that protrudes into the chamber 53 and is obtained by dividing the elastic plate 46 using slits, and thus has a comb-tooth shape; when the elastic portion bends, the introduction channel 52 is opened and closed by a valve member 100.

The elastic plate 46 is anchored by the common portion being held toward the open surface of the chamber 53. Note that any plate-shaped member that is both elastic and ink-resistant can be used as the elastic plate 46, and a stainless steel plate is used in this embodiment.

The supply channel 54 passes through the second flow channel member 42 in the thickness direction thereof, and communicates with a filter chamber 541 via a first supply channel 542 provided passing through the first flow channel member 41 and a second supply flow channel 543 provided between the first flow channel member 41 and the base portion 31. In other words, the ink from the chamber 53 is supplied to the supply port 314 provided in the base portion 31 via the supply channel 54, the first supply channel 542, the second supply flow channel 543, and the filter chamber 541.

Here, the filter 67 for removing foreign objects such as debris, bubbles, and the like contained in the ink is provided in the filter chamber 541, in the same manner as with the filter chamber 554 mentioned earlier. In other words, the ink from the chamber 53 passes through the filter and thus reaches the main head unit 80 via the first supply channel 542, the second supply flow channel 543, the filter 67, the supply port 314, and the head case 70.

Meanwhile, a film holding portion 58 having a concave shape that opposes the corresponding chamber 53 and contains enough space to accommodate the film member 45 deforming is provided in a surface of the protective plate 44 on the side located toward the pressure chamber formation portion 43. Furthermore, an atmospheric release path 59 that exposes a surrounding area of the film holding portion to the external atmosphere is provided in the cover portion 32. Here, a corrugated path 594, which is a meandering concave groove that communicates with the atmospheric release path 59, is provided in the protective plate 44.

The first sealing member 34, a second sealing member 35, and a third sealing member 36 configured of rubber, an elastomer, or the like are provided in the cover portion 32, so as to be separated from each other. The first sealing member 34 is provided so as to span across a leading end surface of the second wall portion 322 in the cover portion 32, and an outer circumferential seam between the base portion 31 and the cover portion 32 is sealed by the first sealing member 34, suppressing the ink within the holding portion 33 of the cover 30 from flowing out to the exterior. The second sealing member 35 is provided in a position opposing the corrugated path 594 of the cover portion 32, and seals an opening of the corrugated path 594 on the side thereof located toward the cover portion 32. The third sealing member 36 is provided on the surface of a projecting portion 324 in which the stated opening portion 323 is provided, on the surface that faces the protective plate 44, so as to span the periphery of the opening portion 323. The third sealing member 36 is used to seal a gap between the periphery of the connection port 51 in the flow channel member 40 and the cover portion 32. By anchoring the third sealing member 36 to the opening portion 323, ink that has leaked when attaching and removing the supply pipe connected to the connection port 51, for example, can be suppressed from flowing into the holding portion 33, and the ink within the holding portion 33 can be suppressed from leaking out from the gap between the periphery of the connection port 51 and the cover portion 32.

Furthermore, the valve member 100 is provided between the introduction channel 52 and the chamber 53, and enables and disables a state of communication between the two. To describe in further detail, a cylindrical case portion 101 that extends in the vertical direction within the introduction channel 52 is formed in a base surface of the pressure chamber formation portion 43. A bottom surface of the case portion 101 makes contact with a base surface of the fourth introduction flow channel 555. The interior of the case portion 101 communicates with the chamber 53, and a slit 102 that enables the inside and outside of the case portion 101 to communicate is provided in a side surface of the case portion 101. Accordingly, the chamber 53 and the introduction channel 52 communicate via the interior of the case portion 101. The valve member 100 is disposed within the case portion 101. The valve member 100 includes a circular column-shaped shaft portion 104 that is inserted into an insertion hole 103 that enables the interior of the case portion 101 to communicate with the chamber 53, and a disk-shaped flange portion 105 that is provided at a lower end of the shaft portion 104 within the case portion 101 and whose outer diameter is greater than an outer diameter of the shaft portion 104. The lower end of the shaft portion 104 is linked to a center of a top surface of the flange portion 105, and an upper end of the shaft portion 104 furthermore makes contact with a lower surface of the elastic plate 46 (located toward the chamber 53).

An outer diameter of the flange portion 105 is greater than an inner diameter of the insertion hole 103, and is slightly smaller than an inner diameter of the case portion 101. In addition, a coil spring 106, serving as a biasing member, is interposed between a bottom surface of the flange portion 105 (the surface located toward the second flow channel member 42) and a base surface of the fourth introduction flow channel 555.

The coil spring 106 continually biases the valve member 100 upward (toward the film member 45), which corresponds to a direction in which the valve is in a closed state. When the valve member 100 is in the closed state, the flange portion 105 makes tight contact with an upper wall surface within the case portion 101 and seals off the insertion hole 103, or in other words, creates a non-communicating state in which the interior of the case portion 101 and the introduction channel 52 do not communicate.

When negative pressure arises in the interior of the chamber 53 due to ink being supplied to the main head unit 80, a resulting difference in pressure from the atmospheric pressure within the film holding portion 58 causes the film member 45 to displace and bend toward the chamber 53 (that is, toward the second flow channel member 42). As a result of the film member 45 displacing in this manner, the elastic portion of the elastic plate 46 elastically deforms so as to bend toward the second flow channel member 42.

As a result of the elastic plate 46 elastically deforming, the shaft portion 104 pushes the valve member 100 upward toward the second flow channel member 42 against the biasing force of the coil spring 106; accordingly, the flange portion 105 retracts from the wall surface in which the insertion hole 103 is opened, enabling the chamber 53 and the introduction channel 52 to communicate.

When the chamber 53 and the introduction channel 52 communicate in this manner, the ink within the introduction channel 52 flows into the chamber 53. Then, when the chamber 53 and the supply channel 54 are sufficiently filled with ink, the negative pressure in the chamber 53 is released, and the elastic plate 46 returns to its original state; furthermore, the interiors of the chambers 53 are continuously held at a constant pressure by the corresponding valve members 100 closing under the biasing force of the corresponding coil springs 106.

In this manner, the backpressure control valve according to this embodiment is configured of the valve member 100, which includes the film member 45, the elastic plate 46, the shaft portion 104, and the flange portion 105, as well as the coil spring 106.

The head case 70 that holds the circuit board 60 with the base portion 31 and the main head unit 80 that is provided in the base surface of the head case 70 are provided in the base surface of the base portion 31 in the backpressure control unit 20. The head case 70 has approximately the same surface area of the base portion 31, is affixed to the base surface of the base portion 31, and holds the circuit board 60 with the base portion 31. The circuit board 60 is disposed so that a connector to which external wires are connected faces upward in a region that is opposite to the wiring insertion hole 312. This circuit board 60 can be used to connect a plurality of main head units 80 in common. Although not particularly shown here, the main head units 80 are provided so that there are two or more rows in which nozzle openings are provided and so that various types of ink supplied from each backpressure control unit 20 can be ejected from corresponding nozzle rows. Furthermore, although not particularly shown in the drawings, pressure generation chambers that communicate with nozzle openings and pressure generating units that cause pressure changes in the pressure generation chambers are provided in the main head units 80. A piezoelectric actuator having a piezoelectric material that provides an electromechanical conversion function and that ejects ink droplets from the nozzle openings by deforming in order to change the volumes of the pressure generation chambers and cause resulting changes in pressure, a unit in which thermal elements are disposed in the pressure generation chambers and ink droplets are ejected from the nozzle openings using bubbles produced by heat from the thermal elements, and a so-called electrostatic actuator that produces static electricity between a vibrating plate and an electrode and causes ink droplets to be ejected from the nozzle openings by causing the vibrating plate to deform using static electricity can be given as examples of such a pressure generating unit.

With the recording head 10 according to this embodiment, the flow channel member 40 having the backpressure control valves is divided into a plurality of blocks and disposed in the base portion 31; it is thus possible to suppress to the greatest extent possible discrepancies in the properties of the backpressure control valves throughout the entire backpressure control unit 20 caused by warping in the backpressure control unit 20 that is configured integrally with the flow channel member 40 and the cover 30, caused by properties of the backpressure control valves themselves, and so on.

Furthermore, design changes can be made to the flow channel member 40 in a flexible manner simply by changing the combinations of a number of the flow channel members 40 resulting from the division.

Second Embodiment

Figure 3:
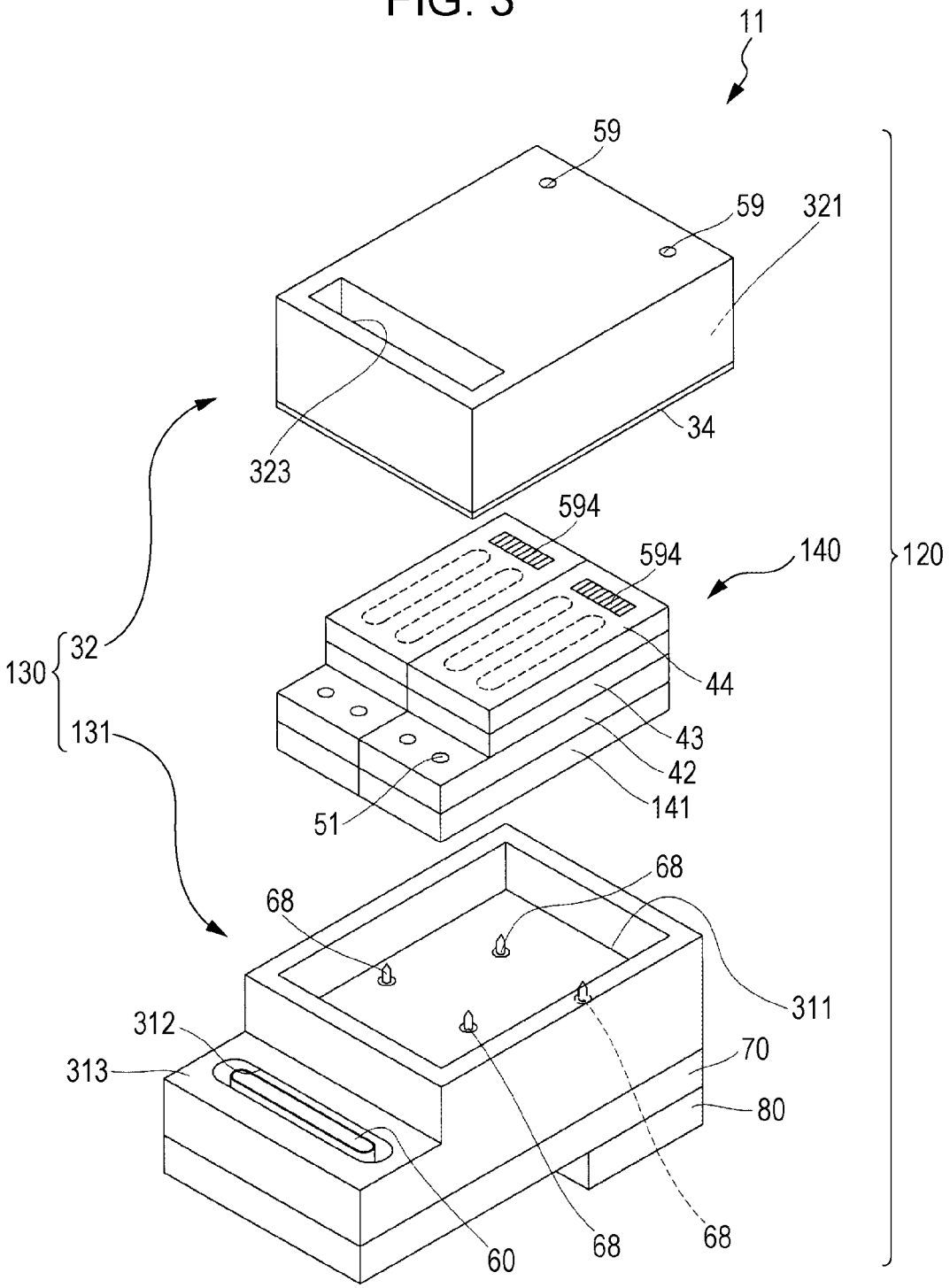
FIG. 3 is an exploded perspective view of a recording head according to a second embodiment of the invention.
Figure 4:
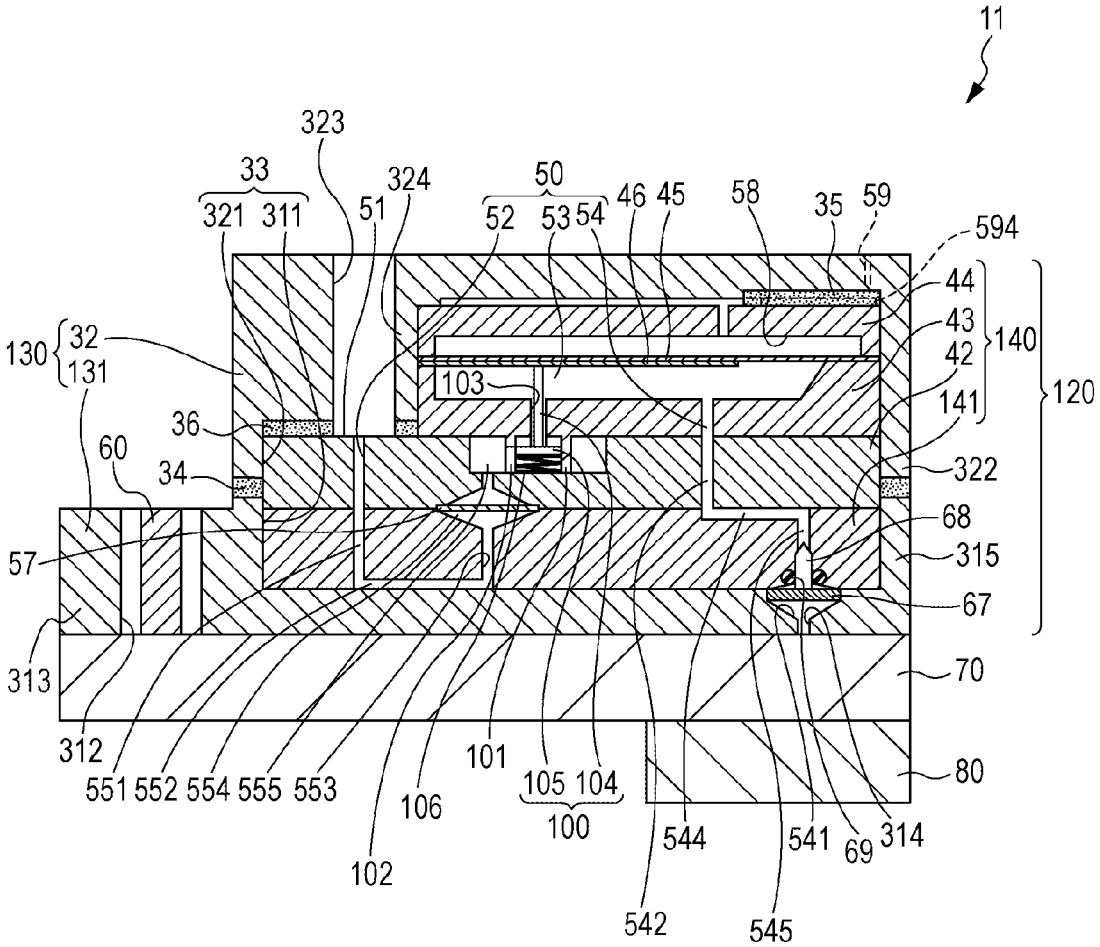
FIG. 4 is a cross-sectional view of the content shown in FIG. 3.

FIG. 3 is an exploded perspective view of an ink jet recording head serving as an example of a liquid ejecting head according to a second embodiment of the invention, whereas FIG. 4 is a cross-sectional view illustrating the same.

As illustrated in FIGS. 3 and 4, a recording head according to the second embodiment of the invention includes a backpressure control unit 120, the circuit board 60 provided in a base area of the backpressure control unit 120, the head case 70 provided below the backpressure control unit 120, and the plurality of main head units 80 anchored to the head case 70, in the same manner as in the first embodiment.

Here, the backpressure control unit 120 according to this embodiment includes a cover 130 configured of a hollow box-shaped member, and a flow channel member 140 serving as a valve unit provided within the cover 130.

The cover 130 is divided vertically into a base portion 131 and the cover portion 32. The flow channel member 140 is configured by stacking a first flow channel member 141, the second flow channel member 42, the pressure chamber formation portion 43, and the protective plate 44 in that order.

In this manner, the recording head 11 according to this embodiment differs in terms of the structure of the first flow channel member 141 and the base portion 131. In other words, in this embodiment, the configuration is such that the flow channel member 140, which is divided into a plurality of parts (two, in FIG. 3), is attached to the base portion 131 in a removable manner. To describe in more detail, a third supply channel 544 formed extending in the horizontal direction of a surface of the first flow channel member 141 so as to communicate with a lower end opening of the first supply channel 542 and a fourth supply channel 545 formed extending in the vertical direction from an end portion of the third supply channel 544 are formed in the first flow channel member 141, and a ring-shaped sealing member 69 is embedded in a lower end of the fourth supply channel 545. In other words, the sealing member 69 is disposed in an opening that is exposed on one side surface (a lower side) of the fourth supply channel 545, and is configured of a ring-shaped elastic member disposed so as to surround the periphery of that opening.

Meanwhile, a pin member 68 disposed corresponding to the opening of the fourth supply channel 545 (and the ring-shaped portion of the sealing member 69) is provided in an upper surface of the filter 67 located toward the base portion 131, and the pin member 68 is affixed as an integral part of the upper surface of the filter 67 located toward the base portion 131. In other words, the pin member 68 is affixed to the base portion 131 while being separated from the flow channel member 140. Accordingly, by inserting the pin member 68 into the sealing member 69 and linking the flow channel member 140 to the base portion 131, the flow channel member 140 and the base portion 131 can be integrated as a single entity. In other words, the flow channel member 140 is formed so as to be removable from the base portion 131.

The other configurations are identical to those of the first embodiment, illustrated in FIGS. 1 and 2. Accordingly, the same reference numerals are assigned to the same constituent elements as those shown in FIGS. 1 and 2, and redundant descriptions thereof will be omitted.

According to this embodiment, the flow channel member 140 that is divided into a plurality of blocks is configured to be removable from the base portion 131, and thus by changing the combinations of the flow channel member 140 in various ways, discrepancies in the properties of the backpressure control valve can be adjusted with ease. Furthermore, the number of flow channel members 140 that are combined can be increased and decreased with a higher degree of flexibility. Here, the base portion 131 is linked to the flow channel member 140 while the sealing member 69 is widened in the outward direction by the pin member 68, and thus the resistive force of the sealing member 69 in the radial direction thereof tightens on the outer circumferential surface of the pin member 68, making it possible to ensure a favorable sealed state between the two.

Further still, it is possible to remove, from the base portion 131, the flow channel member 140 located upstream from the base portion 131, and carry out only ink ejection scans independently using the main head unit 80 located downstream from the base portion 131.

Other Embodiments

Although the invention has been described thus far using exemplary embodiments, the invention is not intended to be limited to the basic configurations described above. For example, the linking portion between the flow channel member 140 and the base portion 131 in the second embodiment is not limited to the combination of the sealing member 69 and the pin member 68, and a flexible tube and a pipe member may be combined as long as they are able to link by applying pressure in a radial direction of the flow channel. This is because resistive force arising from the flexibility of the tube can ensure a favorable seal between the pipe member and the tube.

Figure 5:
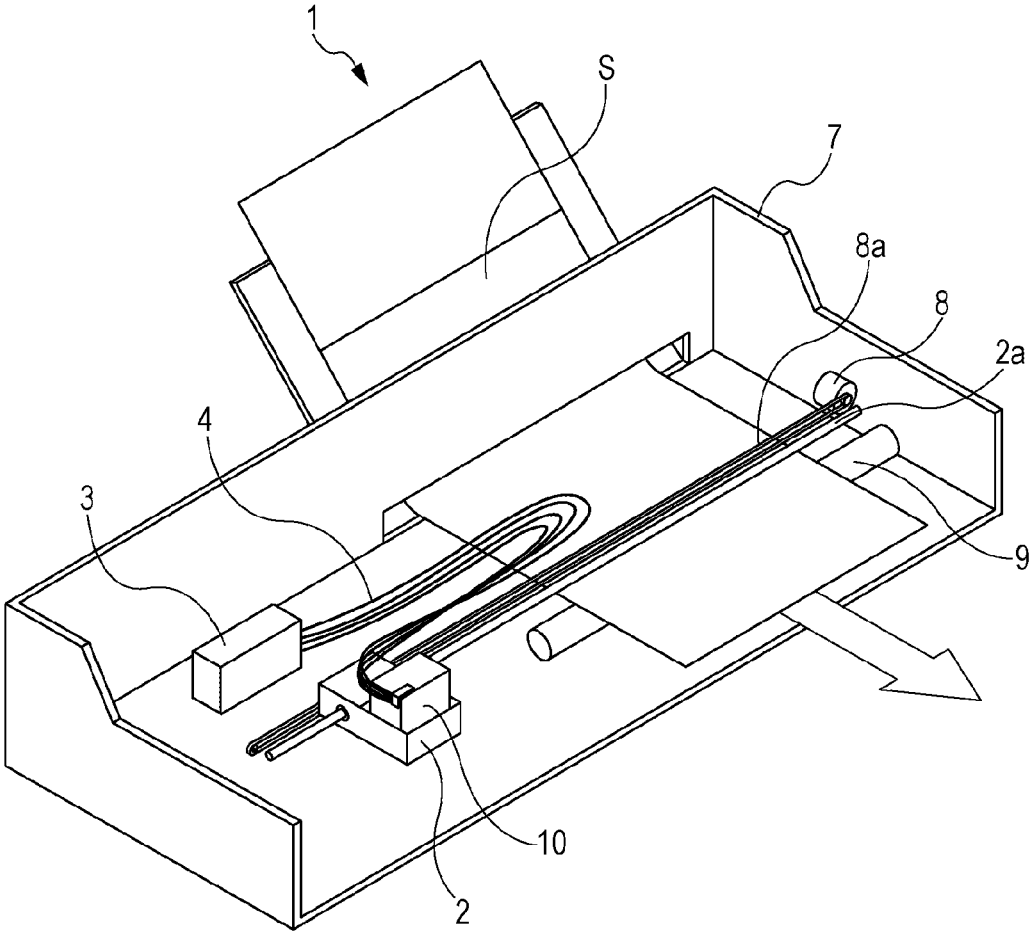
FIG. 5 is an overall perspective view of a recording apparatus according to another embodiment of the invention.

Furthermore, the stated ink jet recording head 10 is mounted in an ink jet recording apparatus. FIG. 5 is an overall perspective view illustrating an example of such an ink jet recording apparatus. As shown in FIG. 5, in an ink jet recording apparatus 1 according to this embodiment, the ink jet recording head 10 is mounted in a carriage 2. The carriage 2 in which the ink jet recording head 10 is mounted is provided so as to be mobile in the axial direction of a carriage shaft 2*a* provided within an apparatus housing 7.

A reservoir unit 3 configured of a tank that holds ink is provided in the apparatus housing 7, and ink from the reservoir unit 3 is supplied to the ink jet recording head (the backpressure control unit 20) mounted in the carriage 2 via a supply pipe 4.

The carriage 2 in which the ink jet recording head is mounted is moved along the carriage shaft 2*a* by a driving motor 8 transmitting driving power to the carriage 2 via a plurality of gears (not shown) and a timing belt 8*a*. Meanwhile, a platen 9 is disposed in the apparatus housing 7 along the same direction as the carriage shaft 2*a*, and a recording sheet S, which is a recording medium such as paper supplied by paper supply rollers and the like (not shown), is entrained and transported by the platen 9.

With such an ink jet recording apparatus 1, the carriage 2 moves along the carriage shaft 2*a* while ink is discharged by the main head unit 80 of the ink jet recording head 10, thereby printing onto the recording sheet S.

In addition, although the above descriptions of the ink jet recording apparatus 1 illustrate an example in which the ink jet recording head 10 is mounted in the carriage 2 and moves along a main scanning direction, the invention is not particularly limited thereto; for example, the invention can also be applied in a so-called line-type recording apparatus, in which the ink jet recording head 10 is anchored to the apparatus housing 7 and printing is performed simply by moving the recording sheet S, which is paper or the like, in a sub scanning direction.

Although the stated examples describe the ink jet recording head 10 as an example of a liquid ejecting head and the ink jet recording apparatus 1 as an example of a liquid ejecting apparatus, the invention applies generally to all types of liquid ejecting heads and liquid ejecting apparatuses, and can of course be applied in liquid ejecting heads, liquid ejecting apparatuses, and so on that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads; the invention can also be applied in liquid ejecting apparatuses that include such liquid ejecting heads.

The entire disclosure of Japanese Patent Application No. 2013-005801, filed Jan. 16, 2013 is incorporated by reference herein.

What is claimed is:

1. A backpressure control unit that introduces a liquid from an external liquid holding unit and supplies the liquid to a main head unit for ejecting the liquid via a nozzle opening, the backpressure control unit comprising:

a base member that is provided above the main head unit and that has an ink supply port for supplying the liquid to the main head unit;

a flow channel member that is configured with stacked multiple plate members, the stacked multiple plate members including:

a first sub flow channel member that is provided on the base member and that has a first ink introduction channel and a first ink supply channel, the first ink introduction channel introducing the liquid from the liquid holding unit, the first ink supply channel supplying the liquid to the ink supply port;

a second sub flow channel member that is provided on the first sub flow channel member and that has a second ink introduction channel, a second ink supply channel and a valve, the second ink introduction channel introducing the liquid from the liquid holding unit and being connected to the first ink introduction channel, the second ink supply channel supplying the liquid to the ink supply port via the first ink supply channel, the valve selectively allowing a flow of the liquid;

a pressure chamber formation member that is provided on the second sub flow channel member and that has a pressure chamber therein, the pressure chamber having a first liquid communication with the liquid holding unit via the first and second ink introduction channels and the valve, the pressure chamber having a second liquid communication with the ink supply port via the first and second ink supply channels; and a protective member that is provided on the pressure chamber formation member; and a cover that is provided on the protective member, wherein the base member and the cover house the flow channel member.

2. The backpressure control unit according to claim 1, wherein the flow channel member is configured to be attachable to and removable from the base member.

3. The backpressure control unit according to claim 2, wherein the flow channel member and the base member are connected by applying pressure in a stacking direction of the stacked multiple plate members.

4. The backpressure control unit according to claim 3, wherein an end, which faces the base member, of the first ink supply channel of the first sub flow channel member has an opening, the opening is provided with a sealing member configured of a ring-shaped elastic portion that surrounds the opening, the ink supply port of the base member is provided with a in that is inserted into the opening so that the first ink supply channel has a third liquid communication with the ink supply port.

5. A liquid ejecting head comprising the backpressure control unit according to claim 1.

6. A liquid ejecting apparatus comprising the liquid ejecting head according to claim 5.

* * * * *